US007143963B2

(12) United States Patent
Tani et al.

(10) Patent No.: US 7,143,963 B2
(45) Date of Patent: Dec. 5, 2006

(54) ROTARY ATOMIZER AND COATING METHOD BY IT

(75) Inventors: Shinji Tani, Aichi-ken (JP); Masahito Sakakibara, Okazaki (JP); Michio Mitsui, Yokohama (JP); Hiroshi Kobayashi, Okazaki (JP); Kimiyoshi Nagai, Yokohama (JP); Toshio Hosoda, Yokohama (JP)

(73) Assignees: Toyota Jidosha Kabushiki Kaisha, Toyota (JP); Ransburg Industrial Fishing KK, Yokohama (JP)

( * ) Notice: Subject to any disclaimer, the term of this patent is extended or adjusted under 35 U.S.C. 154(b) by 263 days.

(21) Appl. No.: 10/937,385

(22) Filed: Sep. 10, 2004

(65) Prior Publication Data

US 2005/0077384 A1 Apr. 14, 2005

(30) Foreign Application Priority Data

Sep. 10, 2003 (JP) ..... 2003-318788

(51) Int. Cl.
*B05B 1/32* (2006.01)
*B05B 1/28* (2006.01)

(52) U.S. Cl. ..... 239/456; 239/290; 239/291; 239/296; 239/451; 239/452; 239/459; 239/690

(58) Field of Classification Search ..... 239/290, 239/451, 296, 294, 291, 293, 301, 452, 456, 239/459, 112, 105, 106, 223, 298, 690, 700–705
See application file for complete search history.

(56) References Cited

U.S. PATENT DOCUMENTS

| | | | | |
|---|---|---|---|---|
| 4,337,895 | A * | 7/1982 | Gallen | 239/7 |
| 4,844,348 | A * | 7/1989 | Rutz | 239/703 |
| 5,078,321 | A * | 1/1992 | Davis et al. | 239/224 |
| 5,749,529 | A * | 5/1998 | Kazama et al. | 239/690 |
| 6,050,499 | A * | 4/2000 | Takayama et al. | 239/112 |
| 6,189,804 | B1 * | 2/2001 | Vetter et al. | 239/7 |
| 6,659,367 | B1 * | 12/2003 | Ballu | 239/223 |
| 6,817,553 | B1 * | 11/2004 | Steur | 239/690 |

FOREIGN PATENT DOCUMENTS

| | | |
|---|---|---|
| JP | 61-074666 | 4/1986 |
| JP | 10-071345 | 3/1998 |

* cited by examiner

*Primary Examiner*—Justine R. Yu
*Assistant Examiner*—James S. Hogan
(74) *Attorney, Agent, or Firm*—Kenyon & Kenyon LLP

(57) ABSTRACT

A coating machine 3 serving as a rotary atomizer comprises a hollow unrotary paint nozzle shaft 5 provided in the center of a motor shaft 10 serving as its rotary shaft. The paint nozzle shaft 5 is provided at a tip thereof with a gun-spray paint nozzle 5*g* and a gun-spray air nozzle 5*f* on the outside of the gun-spray paint nozzle 5*g* in the diametrical direction, and a needle shaft 21 is disposed in a paint passage 5*b* in the paint nozzle shaft 5 so as to serve as a valve mechanism for selectively supplying paint to either a bell cup 4 or the gun-spray paint nozzle 5*g*.

8 Claims, 8 Drawing Sheets

ROTARY ATOMIZER AND COATING METHOD BY IT

This application claims priority to Japanese Patent Application No. 2003-318788 filed 10 Sep. 2003, the content of which is incorporated herein by reference in its entirety.

BACKGROUND OF THE INVENTION

1. Field of the Invention

The present invention relates to a rotary atomizer which atomizes paint so as to coat a target with the paint. In particular, the present invention relates to a rotary atomizer which can serve as both a bell spray and a gun spray.

2. Related Art

A rotary atomizer expands fluid paint on an inner surface of a rotating bell cup so as to atomize the paint by the centrifugal force, and electrifies the paint by static high voltage impressed on an atomizing head or the like and forms an electrostatic field formed between the atomizer and the grounded target, thereby performing electrostatic coating.

There is a well-known conventional rotary atomizer having a cup-like shaped head which is controlled in rotary speed for switching its usage between rotary atomizing mode and air atomizing mode (as disclosed in the Japanese Patent Hei. 4-56674).

There is also a well-known conventional rotary atomizer which can adjust the amount of sprayed air for regulating width of a spray pattern (as disclosed in the Japanese Patent Laid Open Gazette Hei. 10-71345).

A bell-type rotary atomizer makes a spray pattern of a diameter from about 200 to about 1000 mm by the centrifugal force of the rotating bell cup and the electrostatic repulsion among electrostatically charged paint particles. Such a large spray pattern has the difficulty of closely coating targets such as small local points or small products. Even if the charge of static electricity is cut off for the purpose of obtaining a diametrically small spray pattern, the spray pattern is still large because of the centrifugal force and the cutting-off of the static electricity lowers the paint transfer efficiency steeply against the intention.

On the other hand, with regard to workability of coating, since a sufficiently small spray pattern is not obtained with the bell-type rotary atomizer, a hand spray gun can be possibly required for finishing a local point or a small product, thereby causing gross decline of workability and rise of cost.

SUMMARY OF THE INVENTION

An object of the present invention is to provide a bell-type rotary atomizer which can achieve a diametrically small spray pattern for coating such parts as described above and can switch its spray pattern into either diametrically large or small one at any time.

To achieve the object, the bell-type rotary atomizer according to the present invention comprises a hollow unrotary part provided in the center of its rotary shaft, and provided with a gun-spray nozzle for shaping a diametrically small spray pattern. The gun-spray nozzle projects at the center of the rotary bell cup, and incorporates a valve mechanism for optionally switching a spray mode between a bell spray mode and a gun spray mode.

The rotary atomizer according to the present invention performs centrifugal atomizing by rotating a conventional bell type atomizing head (bell cup) with an air motor or the like. The bell cup atomizes paint into paint particles forming a spray pattern of a certain size by the centrifugal force of rotation of the bell cup and the static electricity charged on the particles. Generally, to increase the efficiency of approach of the spray pattern to a target, circular shaping air is sprayed from the peripheral edge of the bell cup so as to regulate the direction of spraying the paint particles in cooperation with the electrostatic force. However, the diameter of the spray pattern cannot be smaller than a certain value regardless of increasing the flow rate of the shaping air.

Then, for obtaining a small spray pattern, the gun-spray nozzle with a small diameter is disposed at the hollow unrotary part in the center of the rotary shaft of the bell type rotary atomizer so that either the large or small pattern can be optionally selected.

The valve is disposed on a paint supply passage so as to optionally selectively supply paint to either a paint nozzle for the bell spray or a paint nozzle for the gun spray, thereby obtaining both the large and small paint spray patterns with the one rotary atomizer. The rotary atomizer according to the present invention is connected to a direct current high voltage generator so as to electrify sprayed paint particles, thereby making electrostatic field between the rotary atomizer and a target for efficiently coating the paint on the target.

In a first aspect of the invention, a rotary atomizer comprises: a bell cup rotated for generating a centrifugal force so as to spread paint; a bell-spray air nozzle for spouting air for shaping a spray pattern of the paint from the bell cup; a rotary shaft for rotating the bell cup; a hollow unrotary part provided in the center of the rotary shaft; a gun-spray paint nozzle provided at a tip part of the unrotary part; a paint passage provided in the hollow unrotary part for supplying paint to the gun-spray paint nozzle; and a gun-spray air nozzle for spouting air to the paint spouted from the gun-spray paint nozzle, the gun-spray air nozzle being disposed diametrically outside of the gun-spray paint nozzle.

Accordingly, the bell-type rotary atomizer can also serve as a gun spray for making a small spray pattern by using the center of its rotary shaft in which a paint supply passage is constructed simply and stably, thereby enhancing its value in operativity and utility.

In the first aspect, preferably, the paint passage is branched so as to also supply paint to the bell cup.

Accordingly, the paint can be spouted in either the bell spray mode or the gun spray mode, and the common paint passage compactly disposed in the center of the rotary shaft of the rotary atomizer is shared between the bell cup for making a large spray pattern and the gun-spray paint nozzle for making a small spray pattern.

Further preferably, a valve is provided in the hollow unrotary part for switching flow of paint in the paint passage to either the bell cup or the gun-spray paint nozzle.

Accordingly, the rotary atomizer can be provided with a simple and durable mechanism for switching the spray of paint between the bell spray mode and the gun spray mode.

Further preferably, the rotary atomizer further comprises a control mechanism for switching flow of air to either the bell-spray air nozzle or the gun-spray air nozzle depending on the switching of the flow of paint to either the bell cup or the gun-spray paint nozzle.

Accordingly, the spray of paint and air can be switched between the bell spray mode and the gun spray mode, and the rotary atomizer is provided with a durable mechanism for ensuring high quality of coating whether it is in the gun spray mode or the bell spray mode.

In a second aspect of the present invention, while a rotary atomizer comprises: a bell cup rotated for generating a centrifugal force so as to spread paint; a rotary shaft for rotating the bell cup; and a hollow unrotary part provided in the center of the rotary shaft, the hollow unrotary part having a tip formed with a gun-spray paint nozzle and a gun-spray air nozzle for spouting air to paint spouted from the gun-spray paint nozzle, the gun-spray air nozzle being disposed diametrically outside of the gun-spray paint nozzle, a coating method by the rotary atomizer comprises selecting whether paint is spouted from the bell cup or the gun-spray paint nozzle.

Accordingly, time and cost for coating is reduced. Particularly, the time for switching between the gun spray mode and the bell spray mode is reduced so as to facilitate for reduction of unevenness of coating caused by the time lag.

In the second aspect, preferably, a valve provided in the hollow unrotary part is shifted so as to switch flow of paint to either the bell cup or the gun-spray paint nozzle.

Accordingly, the spray of paint can be stably switched between the bell spray mode and the gun spray mode, and the valve in the hollow unrotary part can be compactly disposed adjacent to the gun-spray paint nozzle so as to reduce the reaction time of the valve for the switching of the spray mode, thereby improving the value of the rotary atomizer in operativity and utility.

Further preferably, air is spouted from the gun-spray air nozzle at the time of spouting paint from the gun-spray paint nozzle.

Accordingly, the air for the gun spray can be easily obtained.

Further preferably, the rotary atomizer further comprises a bell-spray air nozzle for spouting air for shaping a spray pattern of the paint from the bell cup, wherein air is selectively spouted from either the bell-spray air nozzle or the gun-spray air nozzle depending on whether paint is spouted from the bell cup or the gun-spray paint nozzle.

Accordingly, the high quality of coating is ensured whether it is in the gun spray mode and the bell spray mode.

These, other and further objects, features and advantages will appear more fully from the following description with reference to accompanying drawings.

DETAILED DESCRIPTION OF THE INVENTION

Explanation will be given on an embodiment of the present invention according to attached drawings.

Figure 1:
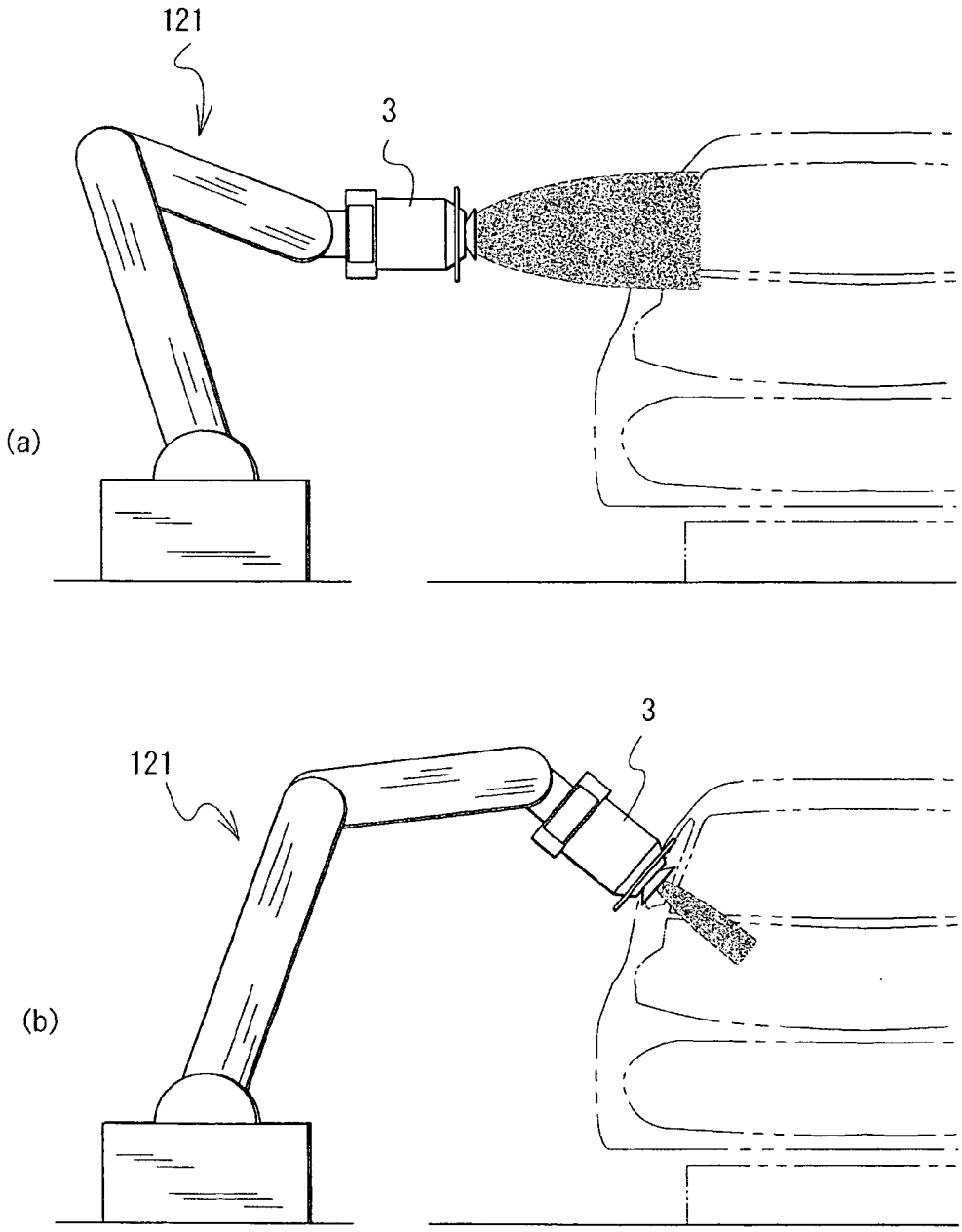
FIG. 1 illustrates usage patterns of a rotary atomizer according to an embodiment of the present invention.

FIG. 1 illustrates an example of usage patterns of a coating machine 3. FIG. 1(*a*) shows the coating machine 3 used in a bell spray mode, and FIG. 1(*b*) shows the coating machine 3 used in a gun spray mode.

As shown in FIG. 1, the coating machine 3 serving as an example of the rotary atomizer according to the present invention is attached to a manipulator of a coating robot 121.

As shown in FIG. 1(*a*), in the coating machine 3 set in the bell spray mode, by rotating a bell cup and electrostatically charging the paint particles, the paint on the bell cup is atomized by the centrifugal force and the static electricity. In this mode, coating is performed with a diametrically large spray pattern. As shown in FIG. 1(*b*), at the time of finishing a local point or a small product, the coating machine 3 is changed into the gun spray mode so as to coat with a diametrically small spray pattern.

Accordingly, only the coating machine 3 is good enough to coat whether the diametrically large or small spray pattern is required, thereby reducing a coating time and improving the efficiency in manufacturing thereof.

Next, explanation will be given on construction of the coating machine 3 according to FIGS. 2 and 3.

Figure 2:
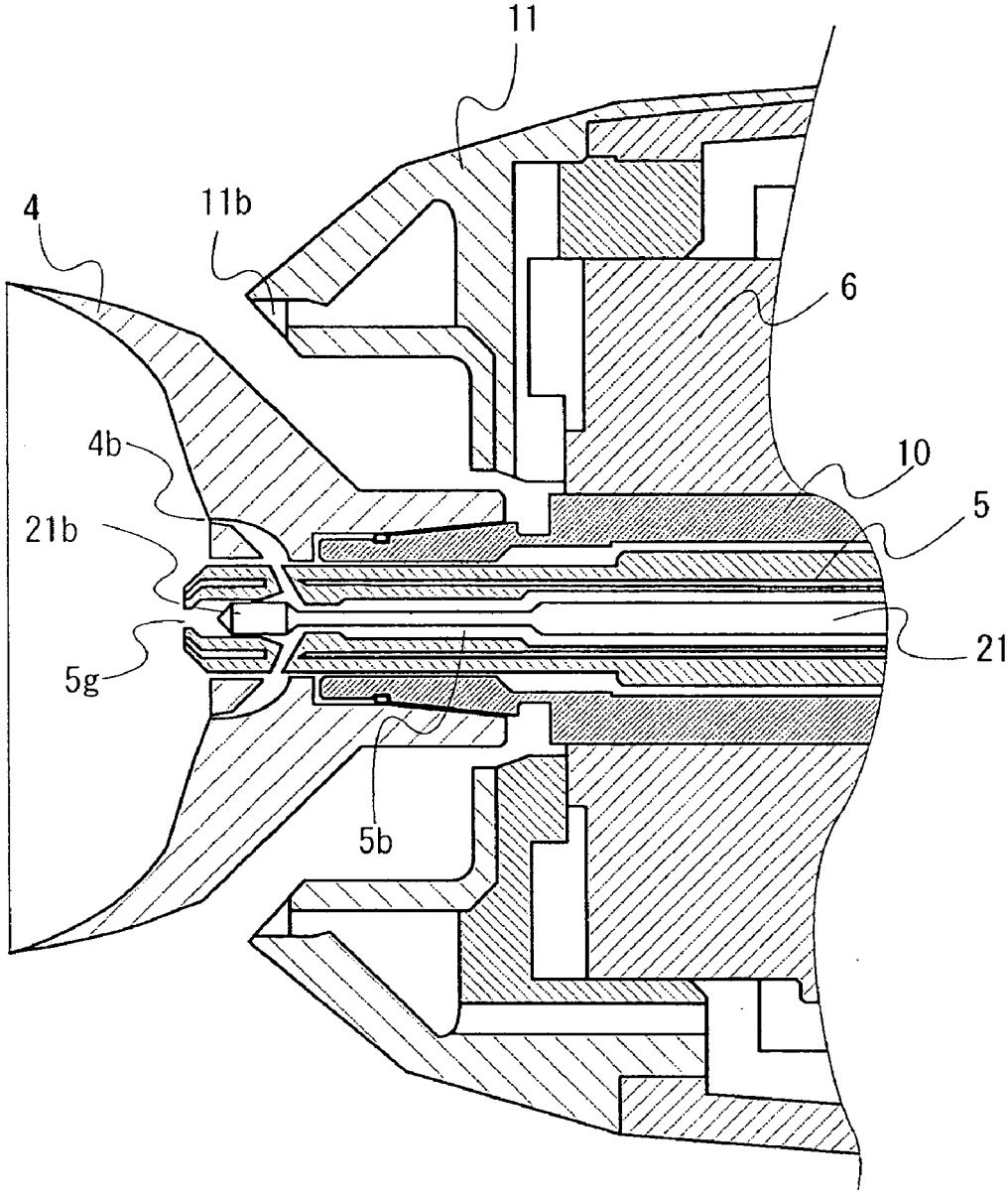
FIG. 2 is a sectional side view of the rotary atomizer.
Figure 3:
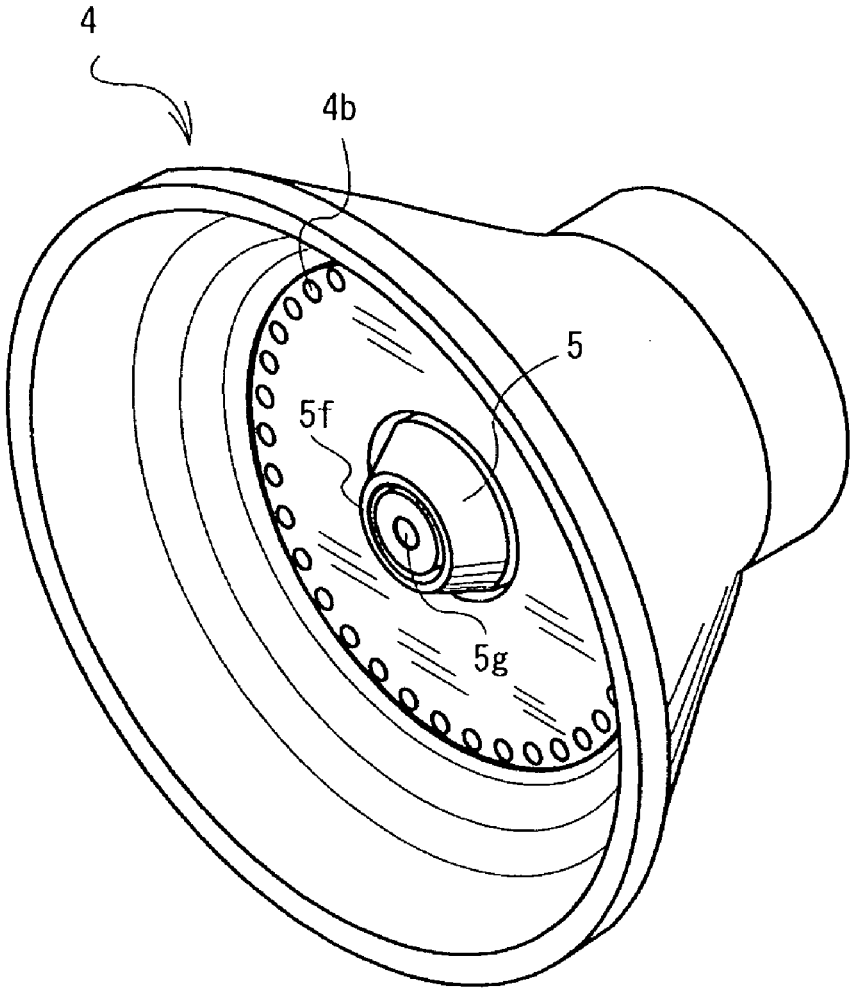
FIG. 3 is a perspective view of a bell cup.

FIG. 2 is a sectional side view of the coating machine 3, and FIG. 3 is a perspective view of a bell cup 4 thereof. The coating machine 3 comprises the bell cup (rotary atomizing head) 4 for atomizing paint, a hollow motor shaft 10 whose tip is attached to the bell cup 4 and which is rotated integrally with the bell cup 4, an air motor 6 for rotating the motor shaft 10, a paint nozzle shaft 5 extended to an inside of the bell cup 4 through a hollow part of the motor shaft 10 so as to supply paint to the bell cup 4, and an air cap 11 having a bell-spray air nozzle 11*b* for spouting shaping air blown to the paint dispersed radially outward from an peripheral edge of the bell cup 4. The air motor 6 is supplied with compressed air so as to drive the motor shaft 10 at high speed.

A tip part of the paint nozzle shaft 5 projects forward from the center of a front surface of the bell cup 4, and bell-spray paint nozzles 4*b* are open at the front surface of the bell cup 4 around the paint nozzle shaft 5.

A high-voltage generator (not shown) impresses high voltage to the bell cup 4 through the air motor 6 and the paint nozzle shaft 5 so as to electrify paint particles atomized by rotation of the bell cup 4, thereby ensuring high paint transfer efficiency of the coating machine 3.

Figure 4:
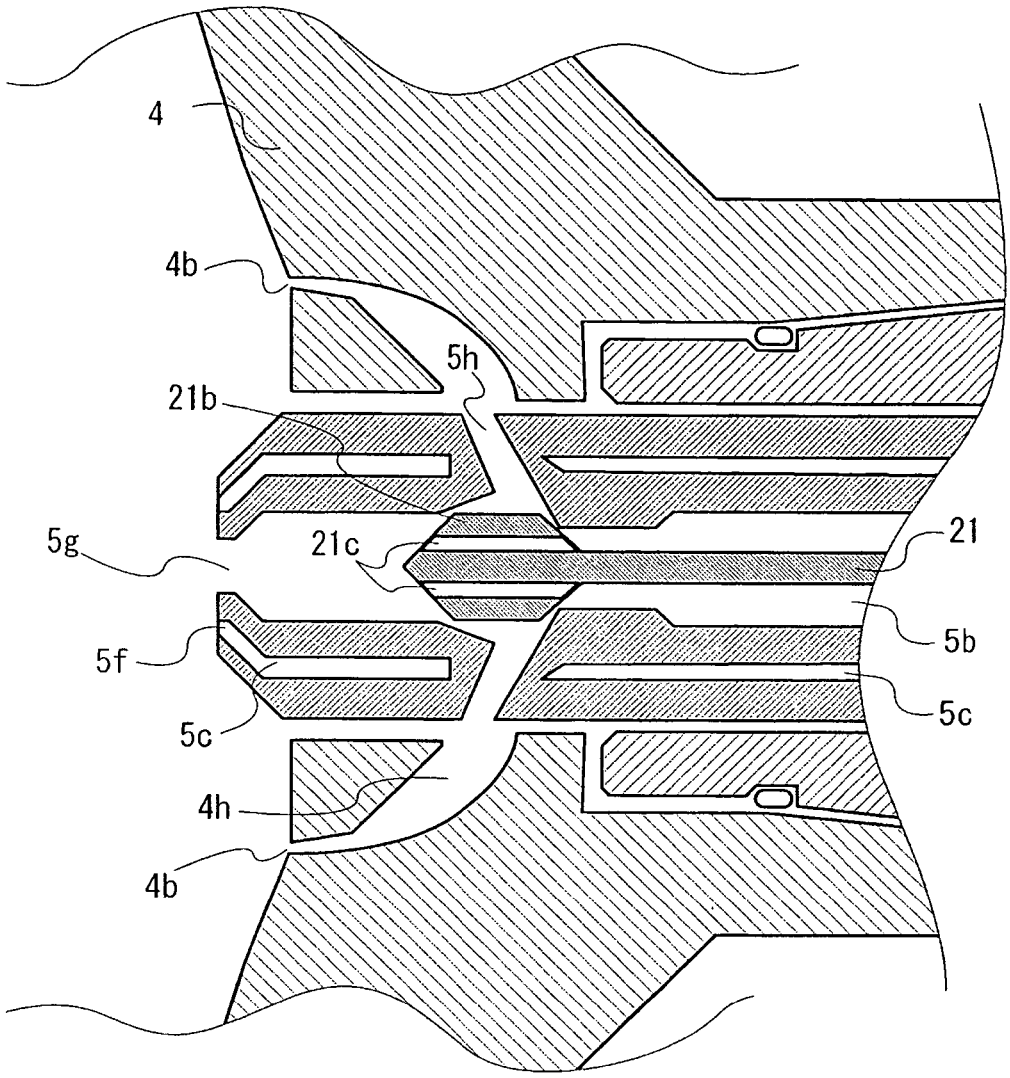
FIG. 4 is a sectional side view of a paint nozzle shaft.

FIG. 4 is a sectional side view of the paint nozzle shaft 5. The paint nozzle shaft 5 penetrates the center of the motor shaft 10 serving as the rotary shaft of the coating machine 3, so as to serve as an unrotary part of the coating machine 3, i.e., be unrotatable regardless of the rotation of the motor shaft 10.

A paint passage 5*b* is axially formed in the center of the paint nozzle shaft 5 so as to pass the paint supplied to the bell cup 4. A needle valve shaft 21 is disposed in the paint passage 5*b* so as to be shifted between two spray positions. Air passages 5*c* for the gun spray are formed within the paint nozzle shaft 5 around the paint passage 5*b*.

The tip part of the paint nozzle shaft 5 is formed in the center portion thereof with a gun-spray paint nozzle 5*g* coaxially connected to the paint passage 5*b*, and tip ends of the air passages 5*c* are formed into gun-spray air nozzles 5*f* around (i.e., diametrically outside of) the gun-spray paint nozzle 5*g* so as to be open at the tip end of the paint nozzle shaft 5.

Bell-spray paint inner nozzles 5*h* are formed to extend substantially radially from the paint passage 5*b* within the tip part of the paint nozzle shaft 5 behind the gun-spray paint nozzle 5*g* without intersecting the air passages 5*c*.

The bell-spray paint inner nozzles 5*h* are positioned to communicate with a bell-like paint gallery 4*h* formed within the bell cup 4 in the state that the paint nozzle shaft 5 is inserted into the bell cup 4. The bell-like paint gallery 4*h* branches into the bell-spray paint nozzles 4*b* open at the front surface of the bell cup 4. Accordingly, paint can be supplied from the paint passage 5*b* to the bell-spray paint nozzles 4*b* through the bell-spray paint inner nozzles 5*h* and the bell-like paint gallery 4*h*.

The needle shaft 21 is disposed in the paint nozzle shaft 5, and formed at its tip part into a switching valve part 21*b* penetrated by paint holes 21*c* in the longitudinal direction of the needle shaft 21.

The switching valve part 21*b* selectively closes either the gun-spray paint nozzle 5*g* or the bell-spray paint inner nozzles 5*h* so as to supply paint to the other from the paint passage 5*b*.

Next, explanation will be given on the valve construction of the needle shaft 21 for switching the spray mode between the bell spray mode and the gun spray mode.

The coating machine 3 is switched between the bell spray mode and the gun spray mode by longitudinal sliding of the needle shaft 21.

Firstly, explanation will be given on the construction of the coating machine 3 set in the bell spray mode.

Figure 5:
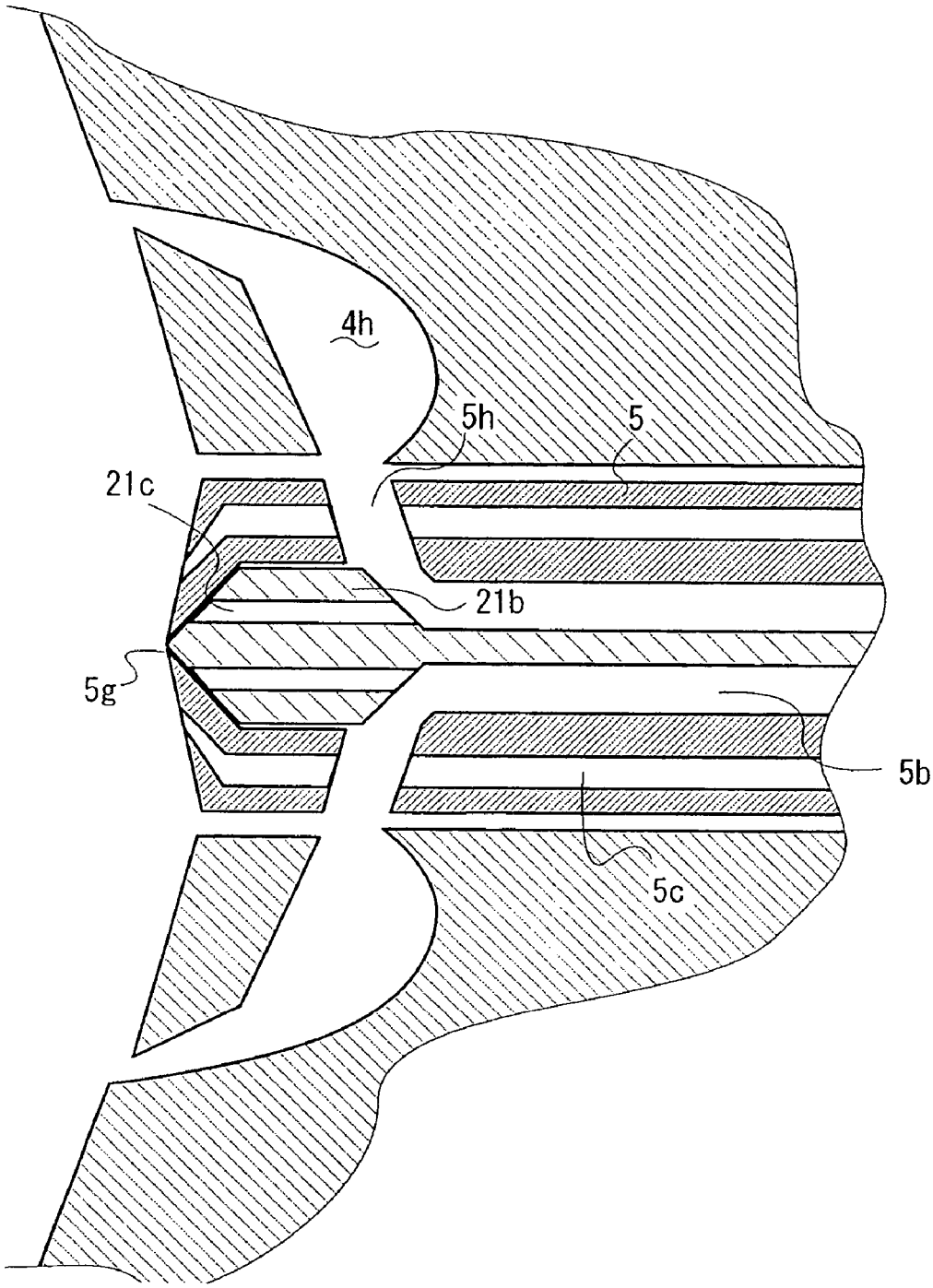
FIG. 5 is a sectional side view of a tip part of the paint nozzle shaft when the rotary atomizer is set in a bell spray mode.
Figure 6:
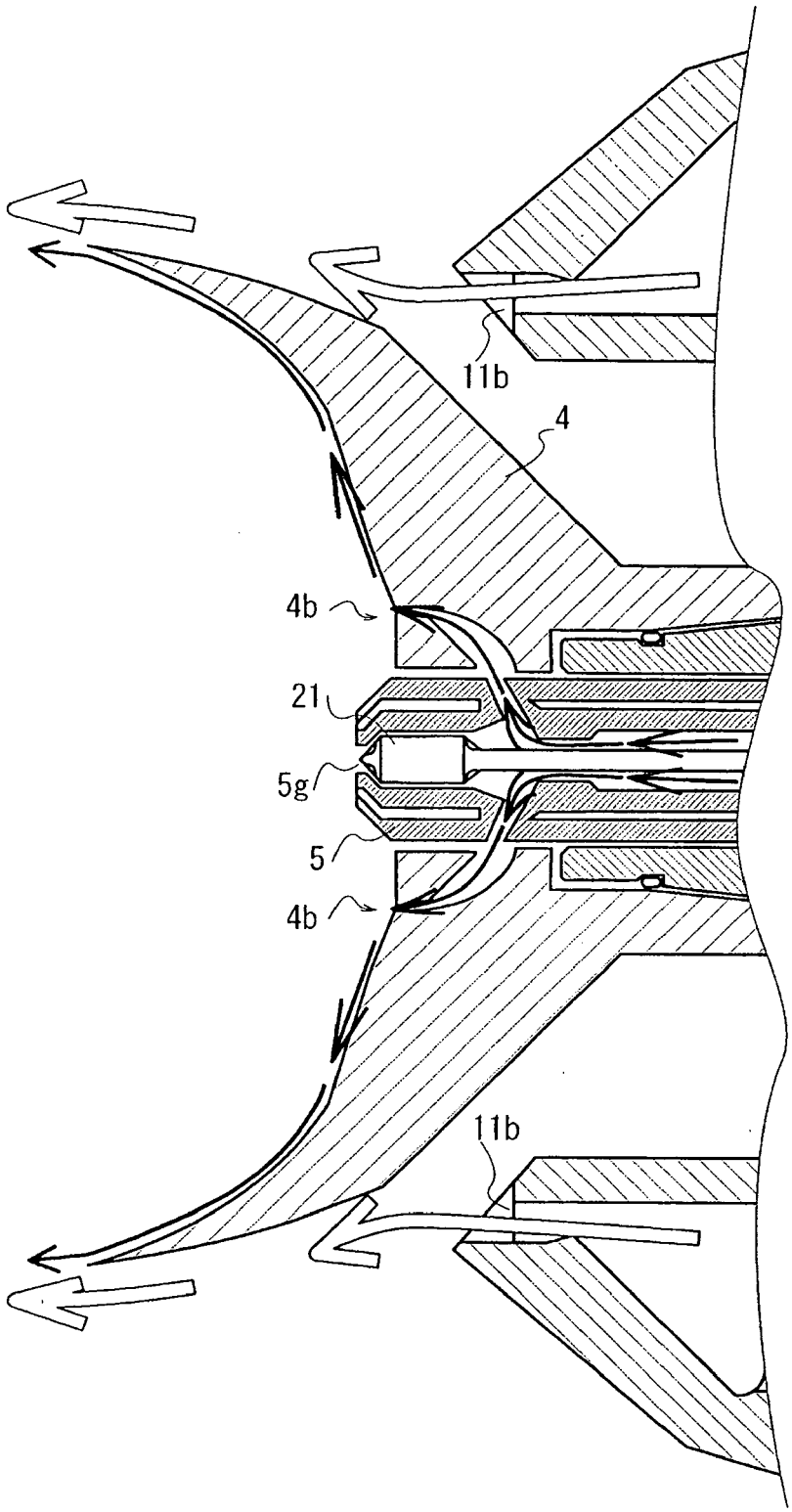
FIG. 6 is a sectional side view of a principal portion of the rotary atomizer showing flows of paint and shaping air when it is set in the bell spray mode.

FIG. 5 is a sectional side view of the valve construction set in the bell spray mode. FIG. 6 is a sectional side view of the valve construction showing flows of paint and shaping air in the bell spray mode.

The needle shaft 21 is shifted between the bell spray position for spraying paint from the bell-spray paint nozzles 4*b* of the bell cup 4 and the gun spray position for spraying paint from the gun-spray paint nozzle 5*g* of the paint nozzle shaft 5. The gun-spray paint nozzle 5*g* is positioned on the tip end of the central axis of the paint nozzle shaft 5. The paint holes 21*c* provided in the switching valve part 21*b* are offset from the gun-spray paint nozzle 5*g*. As shown in FIG. 5, when the needle shaft 21 is slid forward, the front surface of the switching valve part 21*b* of the needle shaft 21 abuts against the inner surface of the needle nozzle shaft 5 so as to close the paint holes 21*c*, and simultaneously the bell-spray paint inner nozzles 5*h* coming behind the switching valve part 21*b* are opened for free passage to the bell-like paint gallery 4*h*, so that the paint supplied from the paint passage 5*b* is sprayed from the bell-spray paint nozzles 4*b* through the bell-spray paint inner nozzles 5*h* and the bell-like paint gallery 4*h*.

The peripheral edge of the bell cup 4 is formed so as to guide shaping air sprayed from the bell-spray air nozzle 11*b* forward, and so the paint sprayed from the bell-spray paint nozzles 4*b* is spouted forward by the shaping air, thereby making the spray pattern in the bell spray mode.

When the coating machine 3 has the spray of the paint switched into the bell spray mode by the forward sliding of the needle shaft 21, the bell-spray air nozzle 11*b* is automatically set to spray shaping air for the bell spray.

Namely, the passage of air is switched cooperation with the switching of the paint passage, whereby paint spraying is stabilized regardless of switching of the spray pattern. The air passage switching mechanism may be provided in the coating machine 3 or in a piping connected to the coating machine 3.

Next, explanation will be given on the valve construction in the gun spray mode.

Figure 7:
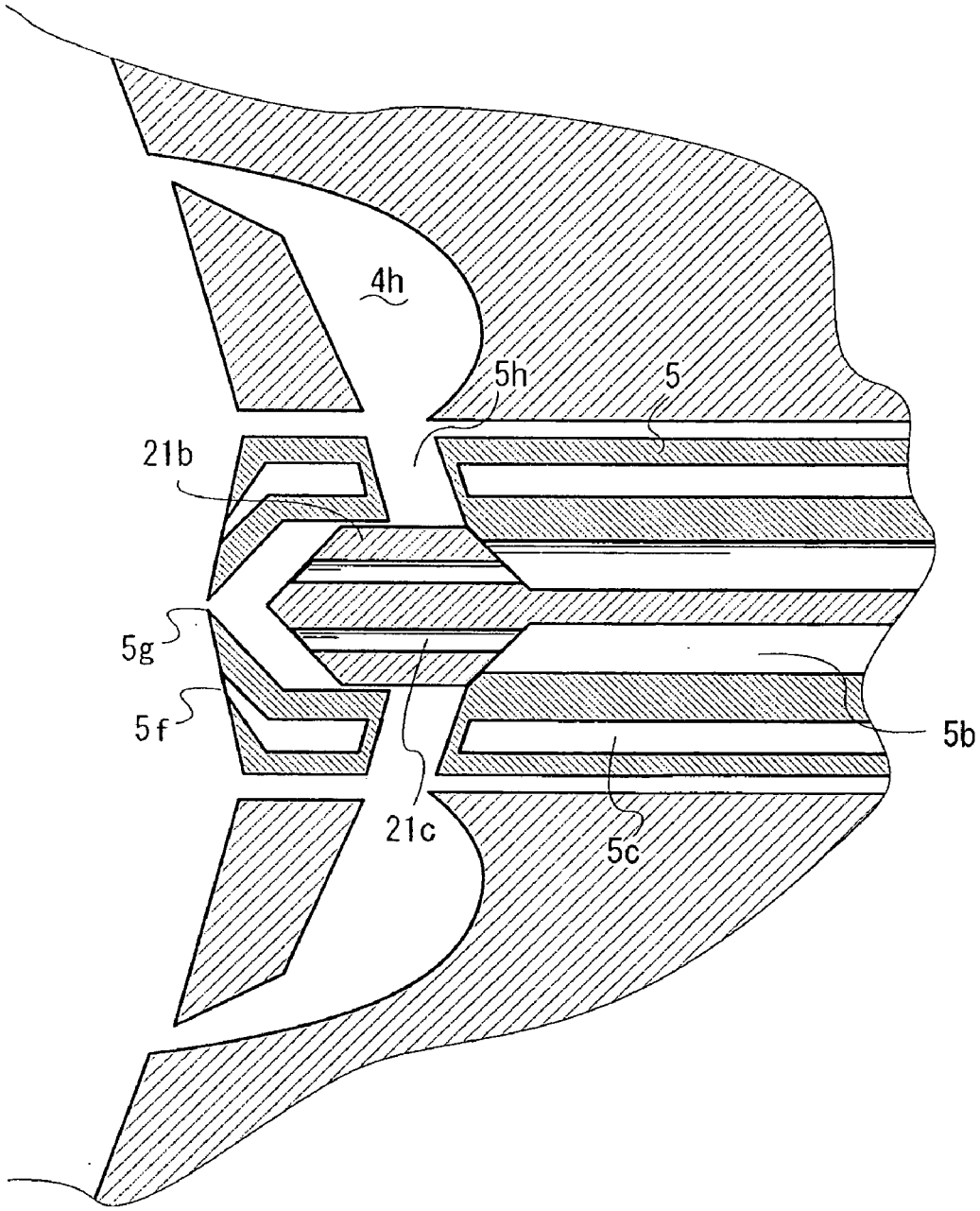
FIG. 7 is a sectional side view of the tip part of the paint nozzle shaft when the rotary atomizer is set in a gun spray mode.
Figure 8:
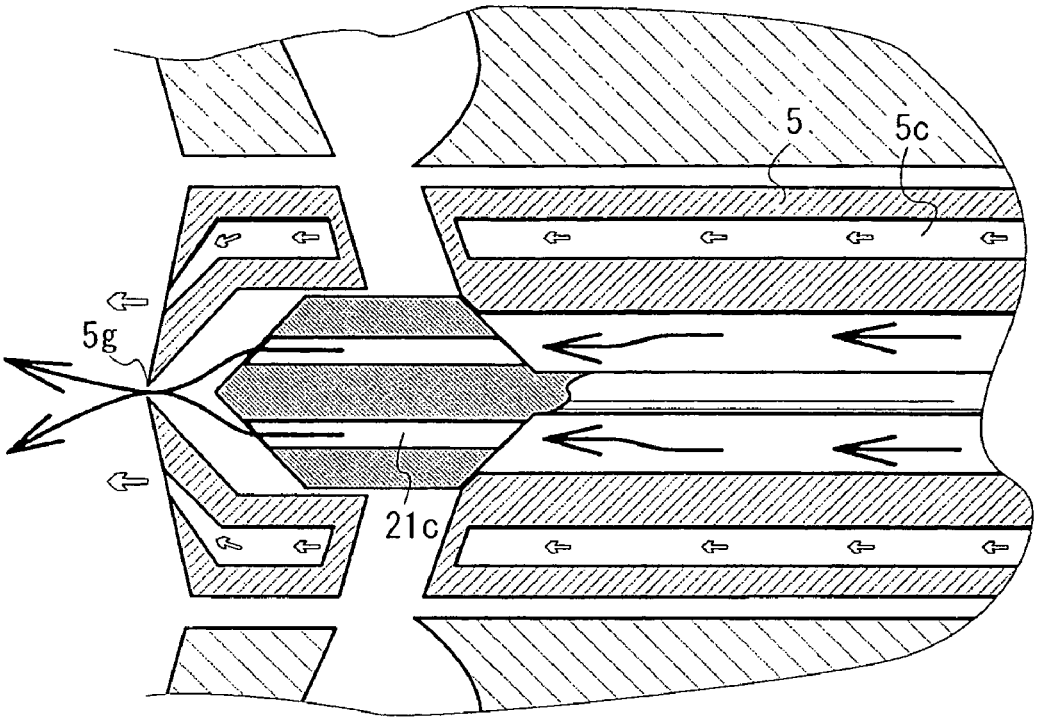
FIG. 8 is a sectional side view of the principal portion of the rotary atomizer showing flows of paint and air when it is set in the gun spray mode.

FIG. 7 is a sectional side view of the valve construction set in the gun spray mode. FIG. 8 is a sectional side view of the valve construction showing flows of paint and air in the gun spray mode.

As shown in FIG. 7, by sliding the switching valve part 21*b* of the needle shaft 21 backward, the bell-spray paint inner nozzles 5*h* are closed and the gun-spray paint nozzle 5*g* is opened. In this regard, the front part of the paint passage 5*b* in which the switching valve part 21*b* slidably fits is stepped at its rear end so that the rear part of the paint passage 5*b* therebehind becomes diametrically smaller than the front part. When the switching valve part 21*b* is slid backward, the switching valve part 21*b* abuts at its rear end against the step of the paint nozzle shaft 5 between the front and rear parts thereof, thereby closing the paint passage 5*b*. At this time, the paint holes 21*c* provided in the switching valve part 21*b* connects the gun-spray paint nozzle 5*g* to the paint passage 5*b* therethrough. Accordingly, paint supplied from the paint passage 5*b* is sprayed from the gun-spray paint nozzle 5*g*.

The gun-spray atomizing air nozzles 5*f* are provided around the gun-spray paint nozzle 5*g*. Paint from the gun-spray paint nozzle 5*g* is atomized and sprayed forward by air spouted from the gun-spray atomizing air nozzles 5*f*, thereby making the spray pattern in the gun spray mode.

When the coating machine 3 has the paint spray switched into the gun spray mode by the backward sliding of the needle shaft 21, the air passage is also switched to spray air from the gun-spray air nozzle 5*f*.

In the coating machine 3, since the paint nozzle shaft 5 is unrotatable, paint sprayed from the gun-spray paint nozzle 5*g* disposed at the tip of the paint nozzle shaft 5 is free from expansion by rotation, whereby the paint spraying is suitable to coat a narrow section. Since the paint nozzle shaft 5 is not rotated, paint is supplied stably through the paint passage 5*b* provided in the paint nozzle shaft 5, and therefore unevenness of the paint spraying is reduced so as to ensure stable coating.

Accordingly, the bell spray mode and the gun spray mode can be switched to each other easily by sliding the needle shaft 21. The air passage is switched corresponding to switching of the paint passage between the bell spray mode and the gun spray mode, whereby the paint spray is stable regardless of switching of the spray pattern.

It is further understood by those skilled in the art that the foregoing description is a preferred embodiment of the disclosed apparatus and that various changes and modifications may be made in the invention without departing from the spirit and scope thereof.

What is claimed is:

1. A rotary atomizer comprising:

a bell cup rotated for generating a centrifugal force so as to spread paint;

a bell-spray air nozzle for spouting air for shaping a spray pattern of the paint from the bell cup;

a rotary shaft for rotating the bell cup;

a hollow unrotary part provided in the center of the rotary shaft;

a gun-spray paint nozzle provided at a tip part of the unrotary part;

a paint passage provided in the hollow unrotary part for supplying paint to the gun-spray paint nozzle; and a gun-spray air nozzle for spouting air to the paint spouted from the gun-spray paint nozzle, the gun-spray air nozzle being disposed diametrically outside of the gun-spray paint nozzle.

2. The rotary atomizer as set forth in claim 1, wherein the paint passage is branched so as to also supply paint to the bell cup.

3. The rotary atomizer as set forth in claim 2, further comprising:

a valve provided in the hollow unrotary part for switching flow of paint in the paint passage to either the bell cup or the gun-spray paint nozzle.

4. The rotary atomizer as set forth in claim 3, further comprising:

a control mechanism for switching flow of air to either the bell-spray air nozzle or the gun-spray air nozzle depending on the switching of the flow of paint to either the bell cup or the gun-spray paint nozzle.

5. A coating method by a rotary atomizer, the rotary atomizer comprising: a bell cup rotated for generating a centrifugal force so as to spread paint; a rotary shaft for rotating the bell cup; and a hollow unrotary part provided in the center of the rotary shaft, the hollow unrotary part having a tip formed with a gun-spray paint nozzle and a gun-spray air nozzle for spouting air to paint spouted from the gun-spray paint nozzle, the gun-spray air nozzle being disposed diametrically outside of the gun-spray paint nozzle, wherein the coating method comprises selecting whether paint is spouted from the bell cup or the gun-spray paint nozzle.

6. The coating method as set forth in claim 5, wherein a valve provided in the hollow unrotary part is shifted so as to switch flow of paint to either the bell cup or the spray gun nozzle.

7. The coating method as set forth in claim 6, wherein air is spouted from the gun-spray air nozzle at the time of spouting paint from the gun-spray paint nozzle.

8. The coating method as set forth in claim 7, the rotary atomizer further comprising a bell-spray air nozzle for spouting air for shaping a spray pattern of the paint from the bell cup, wherein air is selectively spouted from either the bell-spray air nozzle or the gun-spray air nozzle depending on whether paint is spouted from the bell cup or the gun-spray paint nozzle.

* * * * *